US007978045B2

(12) United States Patent
Lee et al.

(10) Patent No.: US 7,978,045 B2
(45) Date of Patent: Jul. 12, 2011

(54) MULTI-ACTUATION MEMS SWITCH

(75) Inventors: Chiung-I Lee, Kaohsiung (TW); Chin-Hung Wang, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 258 days.

(21) Appl. No.: 12/488,462

(22) Filed: Jun. 19, 2009

(65) Prior Publication Data

US 2010/0141362 A1 Jun. 10, 2010

(30) Foreign Application Priority Data

Dec. 4, 2008 (TW) ..... 97147086 A

(51) Int. Cl.
*H01H 71/40* (2006.01)
*H01H 61/00* (2006.01)

(52) U.S. Cl. ..... 337/14; 337/140; 337/298

(58) Field of Classification Search ..... 333/101, 333/105, 262; 335/31, 43, 78; 337/14, 140, 337/298

See application file for complete search history.

(56) References Cited

U.S. PATENT DOCUMENTS

| | | | | |
|---|---|---|---|---|
| 6,486,425 | B2 | 11/2002 | Seki | |
| 6,927,352 | B2 | 8/2005 | Bouche et al. | |
| 6,937,040 | B2 * | 8/2005 | Maeda et al. | 324/754.07 |
| 6,969,630 | B2 * | 11/2005 | Ozgur | 438/53 |
| 7,146,067 | B2 * | 12/2006 | Despont et al. | 385/16 |
| 7,282,393 | B2 * | 10/2007 | Tarn | 438/116 |
| 7,876,120 | B2 * | 1/2011 | Awaji et al. | 324/750.3 |

* cited by examiner

*Primary Examiner* — Dean O Takaoka

(57) ABSTRACT

A multi-actuation MEMS switch for high frequency signals includes a substrate, a heater disposed on the substrate, a co-planar waveguide disposed on a lowest metal layer, and a movable membrane including at least two metal layers, and an dielectric layer disposed between the co-planar waveguide and the movable membrane. The movable membrane is a fixed-fixed beam structure with a center indentation. When heat is generated and conducted to the movable membrane or electrostatic force is generated between the movable membrane and the co-planar waveguide or both forces are generated, the movable membrane will bend toward the co-planar waveguide. The position of the movable membrane change capacitance on signal line for switching the RF signal.

19 Claims, 6 Drawing Sheets

MULTI-ACTUATION MEMS SWITCH

CROSS REFERENCE TO RELATED APPLICATIONS

This Application claims priority of Taiwan Patent Application No. 97147086, filed on Dec. 4, 2008, the entirety of which is incorporated by reference herein.

BACKGROUND OF THE INVENTION

1. Field of the Invention

The invention relates to a multi-actuation MEMS switch.

2. Description of the Related Art

The wireless communication standards have more than seven types today including GSM, Bluetooth, CDMA and WiMAX, etc. Each communication standard has specific characteristics such as frequency and band width. This means communication modules are more and more complex, and higher frequency band is used to satisfy the new necessary. Comparing to diode or transistor, elements fabricated by micro electro mechanical systems (MEMS) technology can provide better radio frequency (RF) performance at Giga Hertz (GHz) applications. Thus, if RF MEMS elements and other electric elements could be integrated as a communication module via complementary metal-oxide-semiconductor (CMOS) technology, size and cost of communication modules can be reduced.

RF switch has numerous applications in RF circuits. For example, switching RF signal through one block to another, or changing RF blocks characteristics directly by switching a capacitor in a tuning network. A well designed RF MEMS switches should demonstrate several characteristics including low actuation voltage, low power consumption, high switching speed, low insertion loss, high isolation, and reliability.

FIG. 1 is a schematic view of MEMS switch, which are drawings of U.S. Pat. No. 6,486,425. The conventional MEMS switch comprises a glass substrate 31, a metal layer 32, two protrusions 33 and 34, two fixed electrodes 35 and 36, a movable terminal 37, and two fixed terminals 38 and 39. The MEMS switch uses the protrusions 33 and 34, and two fixed electrodes 35 and 36 to apply voltage to generate electrostatic force. Thus, the movable terminal 37 is connected to the fixed terminals 38 and 39 and static electricity is driven by higher driving voltages.

FIG. 2 is a schematic view of another MEMS switch, which are drawings of U.S. Pat. No. 6,927,352. A micro switch 10 comprises a silicon oxide layer 11, a beam 12, two heating elements 13 and 14, four complementary electrodes 15, 16, 17 and 18, a contact pad 19, two conductive tracks 20, and 21, a cavity 22 and two metal portions 23 and 24. The heating elements 13 and 14 are located in the beam 12. There are several additional MEMS processes are necessary to form the metal portions 23, 24, which form with underlying membrane and work as bimetal. To turn on switch 10, a current is run through heating elements 13, 14. The heat released by Joule effect causes a deformation of beam 12 that tends to come closer to the conductive tracks 20, 21. The deformation is due to the expansion difference between metal portions and beam 12. The expansion difference is sufficient to obtain the buckling of the central portion of beam 12.

BRIEF SUMMARY OF THE INVENTION

The invention provides an exemplary embodiment of a multi-actuation MEMS switch. The MEMS switch including a substrate and a heater, disposed on the substrate, a movable membrane, comprising a fixed-fixed beam with a center indentation, wherein two metal layers with connecting units to form a three-dimensional structure, a co-planar waveguide, disposed on a lowest metal layer; and a dielectric layer, disposed between the co-planar waveguide and the movable membrane. When the heater generates heat and the heat is conducted to the movable membrane or electrostatic force is generated between the movable membrane and the co-planar waveguide or both are generated, the movable membrane will bend toward the co-planar waveguide.

The multi-actuation MEMS switch embodiment can be fabricated by CMOS process. The switch is actuated by electro-thermal force and electrostatic force at the same time, and then latching the switching status by electrostatic force only. Since thermal actuator relatively need low voltage compare to electrostatic actuator and electrostatic force need almost no power to maintain the switching state. The design may has very low actuation voltage and low power consumption with the actuation speed between electro-thermal and electrostatic actuations.

BRIEF DESCRIPTION OF DRAWINGS

The invention can be more fully understood by reading the subsequent detailed description and examples with references made to the accompanying drawings, wherein.

The invention can be more fully understood by reading the subsequent detailed description and examples with references made to the accompanying drawings.

DETAILED DESCRIPTION OF THE INVENTION

Figure 4:
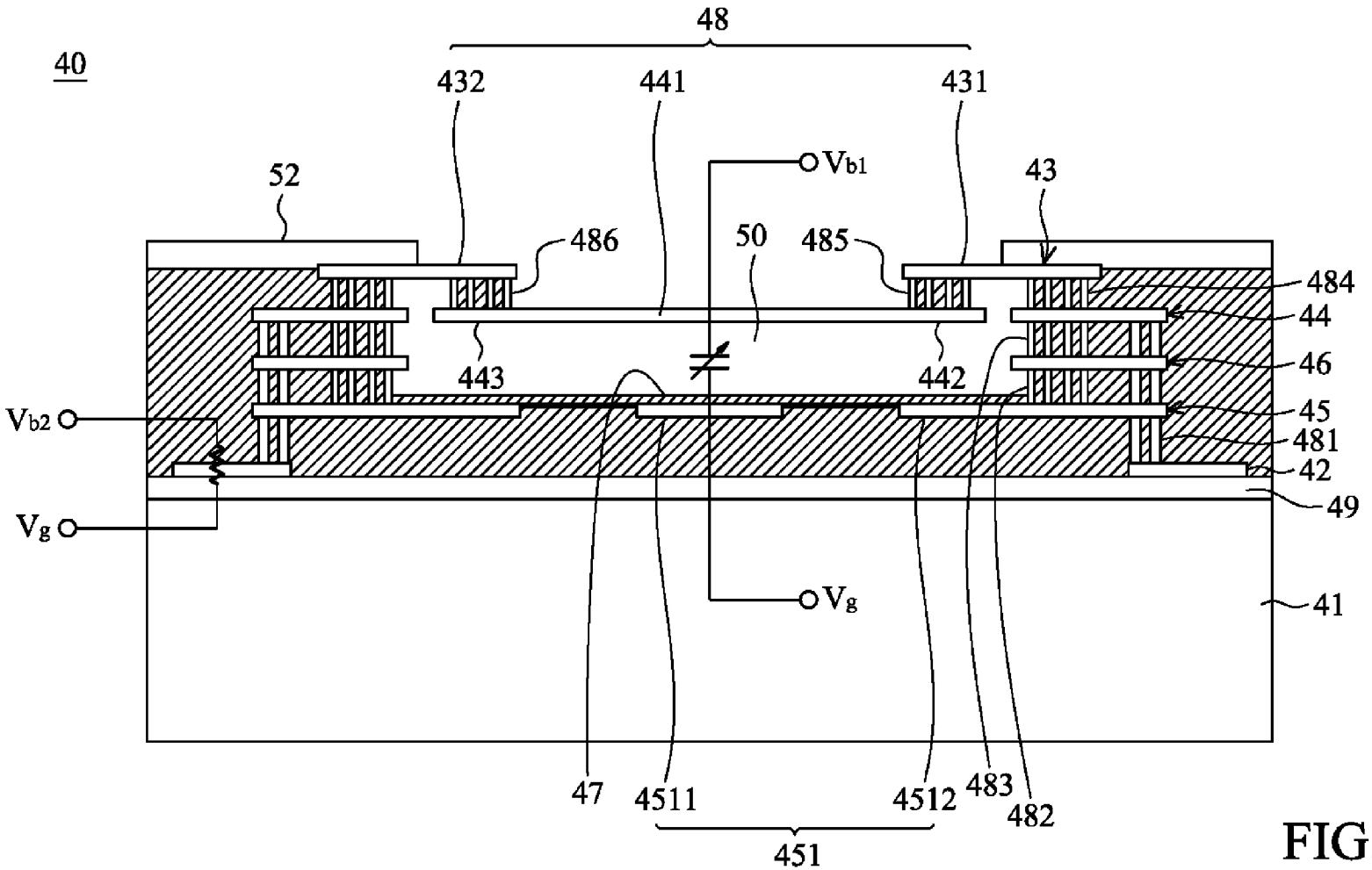
FIG. 4 is a schematic view showing an open circuit of a multi-actuation MEMS switch embodiment after structure release process.

FIG. 4 is a schematic view showing an open circuit of a multi-actuation MEMS switch embodiment. The operation of the multi-actuation MEMS switch is shown in FIG. 4. The multi-actuation MEMS switch comprises a substrate 41, a heater 42 disposed on the substrate 10, a set of co-planar waveguide (CPW) disposed on a lowest metal layer, and a movable membrane 48 suspended above the CPW. The membrane 48 is a three-dimensional structure which could be assembled by two stacked step metal layers with via layer between them. A signal line 4511 is a conductive path. A movable membrane 48 and the signal line form a parallel-plate capacitor. During operation, the movable membrane 48 deforms downward to approach the signal line 4511 generating a relative high capacitance. A high frequency signal passes through the capacitor and the movable membrane 48 to be transmitted to ground end. Thus, the high frequency signal can not pass through the signal line 4511 to the other end.

That is, the signal line is cut off from switching high frequency signal. The multi-actuation MEMS switch can be suitably applied to high frequency (1~10 GHz) and ultrahigh frequency (more than 10 GHz) devices.

Figure 1:
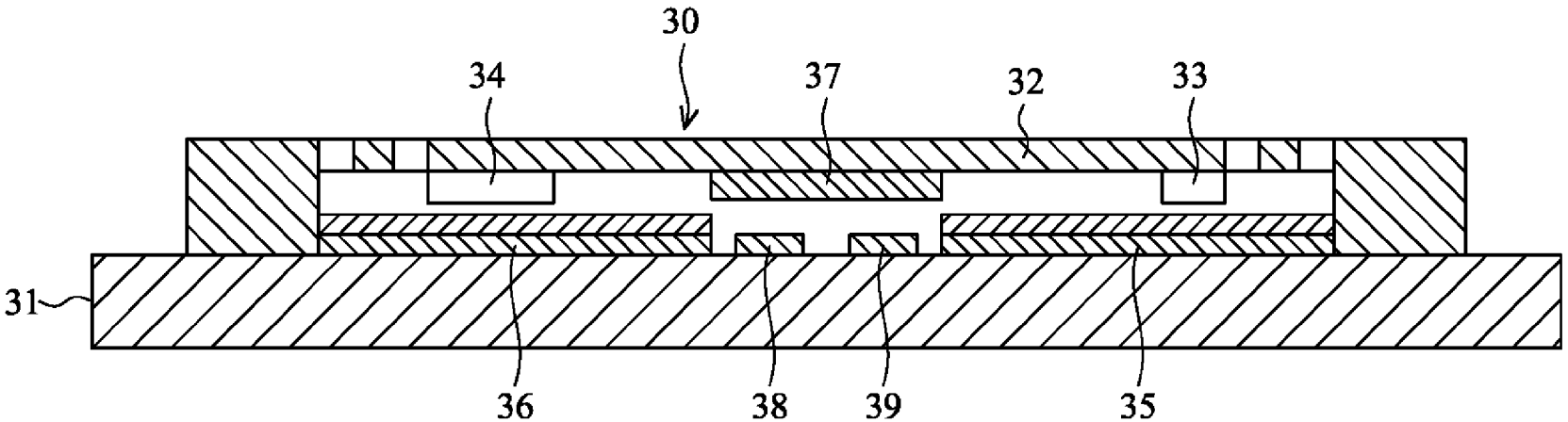
FIG. 1 ( PRIOR ART )
FIG. 1 is a schematic view of a conventional MEMS switch.
Figure 2:
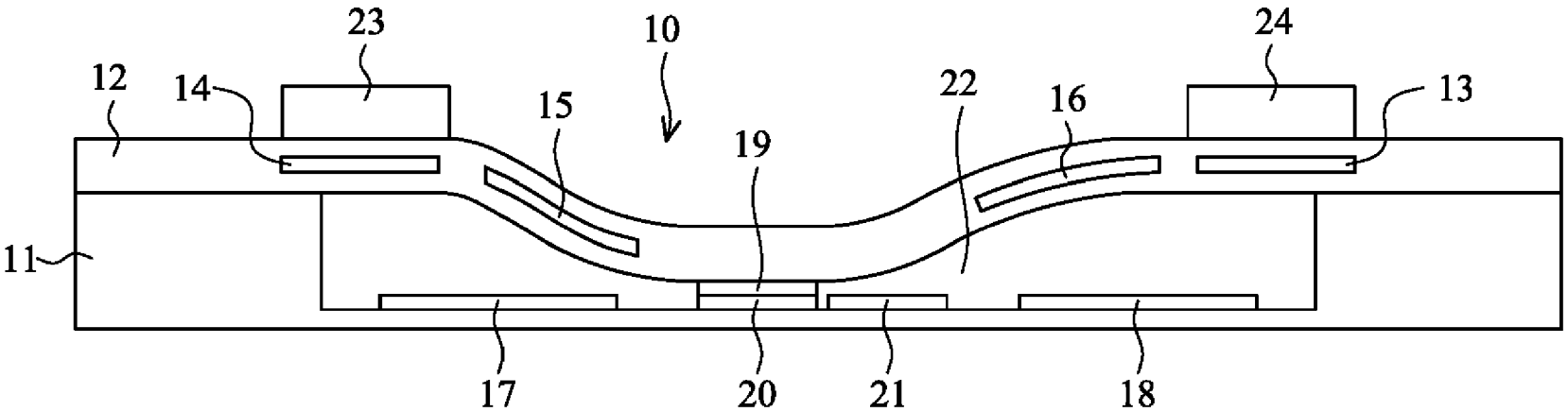
FIG. 2 ( PRIOR ART )
FIG. 2 is a schematic view of another conventional MEMS switch.
Figure 3:
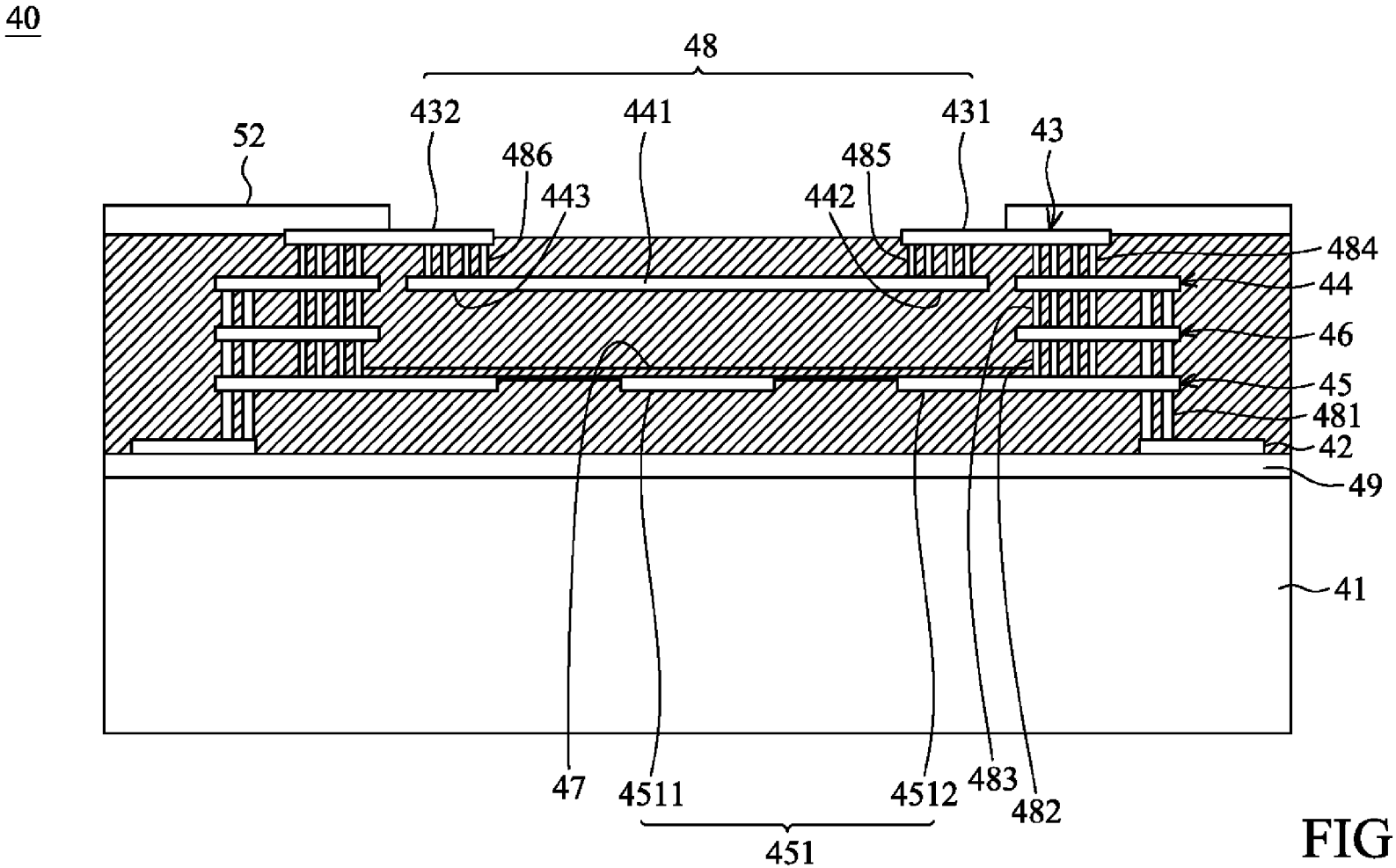
FIG. 3 is a schematic view showing a structure of a multi-actuation MEMS switch embodiment manufactured by a semiconductor wafer foundry.

The multi-actuation MEMS switch embodiment is manufactured by a 2 poly-si layers and 4 metal layers 0.35 μm CMOS (Complementary Metal-Oxide-Semiconductor) process in a semiconductor foundry. An embodiment of multi-actuation MEMS switch manufactured by a semiconductor wafer foundry is shown in FIG. 3. FIG. 3 is a schematic view showing a structure of a multi-actuation MEMS switch embodiment manufactured by a semiconductor wafer foundry. Then, the movable membrane is formed by a wet etching or dry etching process. If a wet etching process is applied, hydrofluoric acid or liquid with better etching ability to $SiO_2$ and slow etching velocity to metal is used as etchant. The released structure of the multi-actuation MEMS switch is shown in FIG. 4. There is still a thin $SiO_2$ layer above lowest metal layer as a dielectric layer.

Figure 6:
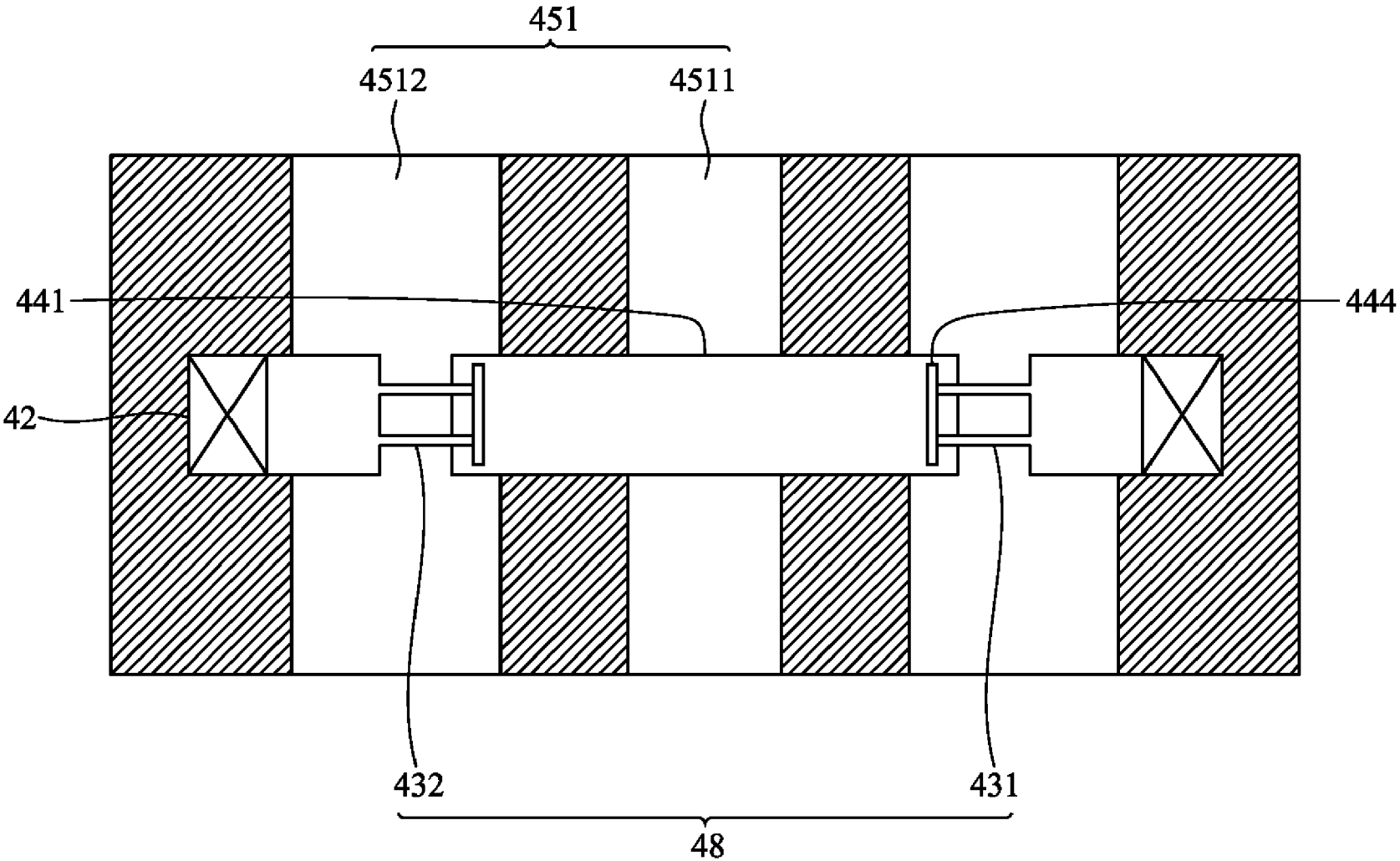
FIG. 6 is a top-view showing first deformed parts on top of a second deformed part, passivation layer are removed.

FIG. 6 is a vertical view showing a second deformed part after a first deformed part, an upper metal layer and a passivation layer are removed. A co-planar waveguide 451 comprises the signal line 4511 and two ground lines 4512. The movable membrane 48 is disposed across the co-planar waveguide 451. The heater 42 is disposed on the out sides of the two sides of the movable membrane 48. The deformed part 441 comprises at least one slot 444 on two sides. The slot 444 can release residual stress on the movable membrane 48 for reducing pre-deformation and improving flexibility.

Figure 5:
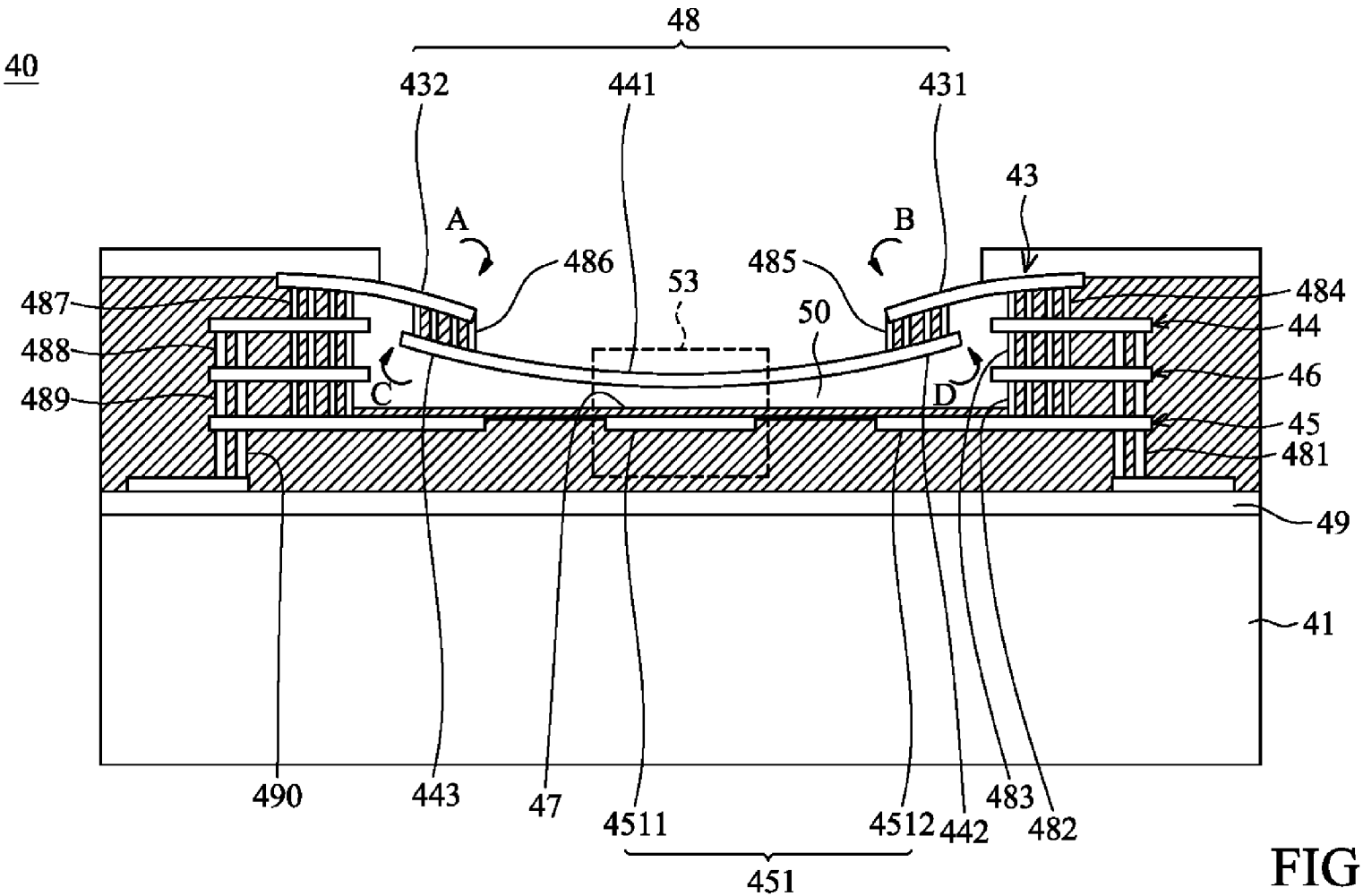
FIG. 5 is a schematic view showing the crossection of a multi-actuation MEMS switch embodiment driven by electro-thermal force or electrostatic force.

FIG. 4 is a schematic view showing an open circuit of a multi-actuation MEMS switch embodiment and FIG. 5 is a schematic view showing a open circuit of RF signal of an embodiment of multi-actuation MEMS switch driven by electro-thermal force or electrostatic force. The multi-actuation MEMS switch 40 for high frequency signals includes a substrate 41, a heater 42, a lowest metal layer 45, a movable membrane 48, a co-planar waveguide 451, a plurality of connecting units 481-486, and an dielectric layer 47. The heater 42 is disposed on the substrate 41. An upper metal layer 43, an adjacent metal layer 44 and the lowest metal layer 45 are overlapped from up to down. The movable membrane 48 is a three-dimensional structure with at least two metal layers. In this embodiment, the movable membrane 48 comprises the upper metal 43 and the adjacent metal layer 44. The co-planar waveguide 451 is disposed on the lowest metal layer 45 and between the movable membrane 48 and the co-planar waveguide 451. A gap 50 is disposed between the adjacent metal layer 44 and the lowest metal layer 45. In addition, one or more overlapped metal layers 46 are disposed between the adjacent metal layer 44 and the lowest metal layer 45. Further, the passivation layer 52 is disposed on the upper metal layer 43.

The upper metal layer 43 comprises two first deformed parts 431and 432. The adjacent metal layer 44 comprises a second deformed part 441. The co-planar waveguide 451 is disposed on the lowest metal layer 45. The connecting unit 481 connects the heater 42 to the lowest metal layer 45. The connecting unit 482 is connected to the lowest metal layer 45 and overlapped metal layer 46. The connecting unit 483 is connected to the overlapped metal layer 46 and the adjacent metal layer 44. The connecting unit 484 is connected to the adjacent metal layer 44 and the upper metal layer 43. The connecting units 485 and 486 connect the first deformed parts 431 and 432 to the second deformed part 441.

In this embodiment, the outside fixed ends of the first deformed parts 431 and 432 expend to the center of the gap 50 and are disposed on two sides of the second deformed part 441. The dielectric layer 47 is disposed on the co-planar waveguide 451, or below the second deformed part 441. The gap 50 is disposed on the central area of the multi-actuation MEMS switch 40 and between the second deformed part 441 and the dielectric layer 47. When the multi-actuation MEMS switch 40 is in an on-state, the second deformed part 441 does not contact to the dielectric layer 47. In this embodiment, the heater 42 is made of poly-Si. The substrate 41 is made of Si with an oxide layer above it. The connecting units 481-486 are made of tungsten.

Referring to FIGS. 4 and 5, $V_g$ is ground voltage, when bias voltage $V_{b1}$ is applied to the heater 42 or bias voltage $V_{b2}$ is applied to the second deformed part 441, the membrane 48 will be actuated. When $V_{b2}$ is applied, the heater 42 generates heat and then conducted to the lowest metal layer 45, the overlapped metal layer 46, the adjacent metal layer 44, and the upper metal layer 43 via the connecting units 481-486. When heat conducted to the first deformed parts 431 and 432 of the upper metal layer 43, the first deformed part 431 extends to the center of the gap 50 and bends along an arrow A (toward the substrate 41). Similarly, the first deformed part 432 extends to the center of the gap 50 and bends along an arrow B (toward the substrate 41). Because the first deformed parts 431 and 432 link to two end parts 442 and 443 of the second deformed part 441 via the connecting units 485 and 486, heat is conducted to the second deformed part 441. The second deformed part 441 is extended and linked by the first deformed parts 431 and 432, thus the center thereof is bending toward the substrate 41. That is, the end parts 442 and 443 of the second deformed part 441 are bending along arrows C and D. Specifically, the first deformed parts 431 and 432 are bending toward the substrate 41 following heating, and thereafter the second deformed part 441 linked to the first deformed parts 431 and 432 is bending toward the substrate 41. Besides, when a bias voltage $V_{b1}$ is applied to the second deformed part 441, and the bias voltage is bigger than pull-in voltage. The electrostatic force is generated between the second deformed part 441 and the signal line 4511 of the co-planar waveguide 451 such that the second deformed part 441 will be attracted to the signal line 4511 until the second deformed part 441 contacts the dielectric layer 47. When the second deformed part 441 contacts the dielectric layer 47, the structure works as a parallel-plate capacitor 53. A high frequency signal will go through the parallel-plate capacitor 53 and be transmitted to the ground line 4512 (shown on FIG. 3) on two sides of the co-planar waveguide 451. At this time, the multi-actuation MEMS switch 40 is on off state. Note that the movable membrane 48 is a fixed-fixed beam structure with a center indentation. The first deformed part 441 is connected to the second deformed parts 431 and 432 to form the fixed-fixed beam structure with the center indentation. The second deformed part 441 is disposed lower than the first deformed parts 431 and 432.

The multi-actuation MEMS switch embodiment 40 uses electrostatic force and electro-thermal force to change the membrane position for controlling high frequency signals to pass or not to pass through the signal line. When implemented, one of electrostatic force or heat or both are used for deformation.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A multi-actuation MEMS switch, comprising:

a substrate;

a heater, disposed on the substrate;

a movable membrane, comprising a fixed-fixed beam with a center indentation, wherein two metal layers with connecting units to form a three-dimensional structure;

a co-planar waveguide, disposed on a lowest metal layer; and a dielectric layer, disposed between the co-planar waveguide and the movable membrane;

wherein when the heater generates heat and the heat is conducted to the movable membrane or electrostatic force is generated between the movable membrane and the co-planar waveguide or both are generated, the movable membrane will bend toward the co-planar waveguide.

2. The multi-actuation MEMS switch as claimed in claim 1, further comprising a gap, disposed between the movable membrane and the co-planar waveguide.

3. The multi-actuation MEMS switch as claimed in claim 1, wherein the movable membrane comprises an upper metal layer and an adjacent metal layer, and the upper metal layer comprises a first deformed part, the adjacent metal layer comprises a second deformed part, the first deformed part is connected to the second deformed part to form the fixed-fixed beam structure with the center indentation, the second deformed part is disposed lower than the first deformed part, and when the heater generates heat to be conducted to the movable membrane or electrostatic force is generated between the movable membrane and the co-planar waveguide or both are generated, the second deformed part contacts the dielectric layer.

4. The multi-actuation MEMS switch as claimed in claim 3, wherein the co-planar waveguide comprises two ground lines, and when the second deformed part contacts the dielectric layer, which is forming a parallel-plate capacitor, and a high frequency signal is transmitted through the parallel-plate capacitor to the ground lines.

5. The multi-actuation MEMS switch as claimed in claim 3, wherein the first deformed part bends toward the substrate after being heated, and the central part of the second deformed part is influenced by the first deformed part to bend toward the substrate and contacts the dielectric layer.

6. The multi-actuation MEMS switch as claimed in claim 3, further comprising a plurality of overlapped metal layers, disposed between the adjacent metal layer and the lower metal layer.

7. The multi-actuation MEMS switch as claimed in claim 3, further comprising a passivation layer, disposed on the upper metal layer.

8. The multi-actuation MEMS switch as claimed in claim 3, wherein the second deformed part comprises a plurality of slots to release residual stress on the second deformed part.

9. The multi-actuation MEMS switch as claimed in claim 3, wherein a voltage is applied between the second deformed part and the co-planar waveguide to generate electrostatic force.

10. The multi-actuation MEMS switch as claimed in claim 3, further comprising a connecting unit, to connect to the first deformed part and the second deformed part of the movable membrane, and other paths that require transmitting electric signal or conducting heat.

11. The multi-actuation MEMS switch as claimed in claim 10, wherein the first deformed part is disposed above the second deformed part and on two sides of the second deformed part, and the second deformed part comprises at least two end parts, and the first deformed part is connected to the connecting unit via the end parts.

12. The multi-actuation MEMS switch as claimed in claim 10, wherein the connecting unit is made of tungsten.

13. The multi-actuation MEMS switch as claimed in claim 1, wherein the heater generates electro-thermal force by applying a voltage on the heater.

14. The multi-actuation MEMS switch as claimed in claim 1, wherein the heater is made of poly-Si.

15. The multi-actuation MEMS switch as claimed in claim 1, wherein an upper surface of the substrate is made of high resistance material with an oxide layer.

16. The multi-actuation MEMS switch as claimed in claim 1, wherein an upper surface of the substrate is made of Si substrate with an oxide layer.

17. The multi-actuation MEMS switch as claimed in claim 3, wherein the dielectric layer is disposed on the co-planar waveguide.

18. The multi-actuation MEMS switch as claimed in claim 1, wherein the dielectric layer is disposed under the second deformed part.

19. The multi-actuation MEMS switch as claimed in claim 1, wherein the dielectric layer is disposed on the lowest metal layer.

* * * * *